United States Patent [19]

Pham et al.

[11] Patent Number: 4,698,469

[45] Date of Patent: Oct. 6, 1987

[54] SULFUR HEXAFLUORIDE CIRCUIT BREAKER OPERATING IN A VERY LOW TEMPERATURE ENVIRONMENT

[75] Inventors: Van Doan Pham, Meyzieu; Edmond Thuries, Pusignan, both of France

[73] Assignee: Alsthom, Paris, France

[21] Appl. No.: 862,941

[22] Filed: May 14, 1986

[30] Foreign Application Priority Data

| | | | |
|---|---|---|---|
| May 15, 1985 | [FR] | France | 85 07437 |
| Jul. 31, 1985 | [FR] | France | 85 11717 |
| Feb. 10, 1986 | [FR] | France | 86 01771 |

[51] Int. Cl.[4] ..... H01H 33/57

[52] U.S. Cl. ..... 200/148 E; 200/148 B; 200/148 G; 200/150 A

[58] Field of Search ..... 200/148 E, 148 G, 150 A, 200/148 B, 148 R

[56] References Cited

U.S. PATENT DOCUMENTS

| | | | |
|---|---|---|---|
| 3,721,798 | 3/1973 | Beierer | 200/148 E |
| 3,723,685 | 3/1973 | Thurk et al. | 200/148 E |
| 4,273,978 | 6/1981 | Rostron | 200/148 E |
| 4,326,867 | 4/1982 | Stokes | 200/148 E |

FOREIGN PATENT DOCUMENTS

| | | | |
|---|---|---|---|
| 1037551 | 8/1958 | Fed. Rep. of Germany | 200/148 E |
| 2063081 | 2/1979 | Fed. Rep. of Germany | 200/148 E |
| 1136382 | 12/1956 | France | 200/148 E |
| 400293 | 4/1966 | Switzerland | 200/148 E |
| 1068673 | 5/1967 | United Kingdom | 200/148 E |

*Primary Examiner*—Robert S. Macon

*Attorney, Agent, or Firm*—Sughrue, Mion, Zinn, Macpeak & Seas

[57] ABSTRACT

A high pressure circuit breaker comprising a sealed enclosure (1) having a fixed assembly (10) and a moving assembly (20) disposed therein, said fixed assembly and said moving assembly each including a respective main contact and a respective arcing contact, and said enclosure being filled with gas under pressure constituted, at least in part, by sulfur hexachloride, the circuit breaker including the improvement of a fluid condenser (30) disposed outside the circuit breaker with the inside of the condenser being in communication with the inside of the enclosure via at least one first channel (31) for transferring gas between the inside of the enclosure and the condenser, and via at least one second channel (32) for transferring liquified gas from inside the condenser to the inside of the enclosure.

30 Claims, 11 Drawing Figures

SULFUR HEXAFLUORIDE CIRCUIT BREAKER OPERATING IN A VERY LOW TEMPERATURE ENVIRONMENT

The present invention relates to a high tension sulfur hexafluoride ($SF_6$) circuit breaker.

BACKGROUND OF THE INVENTION

Circuit breakers of this type are often installed in the open air and may be required to operate at very low temperature.

When a circuit breaker is filled with $SF_6$ at a relative pressure of 5 bars and at 20° C., there is a danger of the gas condensing when the outside temperature drops to −30° C. The internal pressure drops to 2.3 bars at −50° C.

These circumstances give rise to two types of drawback:

firstly, drops of liquid from the condensing gas which form on the inside walls of the circuit breaker (porcelain) may give rise to sparking between live components; and secondly, the low gas pressure, due to the low temperature, reduces the quality of the insulation in the circuit breaker and may lead to arcs restriking during circuit breaker opening.

One aim of the present invention is to provide a circuit breaker in which there is no danger of condensation taking place on the side walls of the circuit breaker.

Another aim of the invention is to provide a circuit breaker in which at least some of the condensed gas is evaporated in order to maintain the gas density at a level which is compatible with good circuit breaker operation.

SUMMARY OF THE INVENTION

The present invention provides a circuit breaker comprising a sealed enclosure having a fixed assembly and a moving assembly disposed therein, said fixed assembly and said moving assembly each including a respective main contact and a respective arcing contact, and said enclosure being filled with gas under pressure constituted, at least in part, by sulfur hexafluoride, the circuit breaker including the improvement of a fluid condenser disposed outside the circuit breaker with the inside of the condenser being in communication with the inside of the enclosure via at least one first channel for transferring gas between the inside of the enclosure and the condenser, and via at least one second channel for transferring liquified gas from the inside of the condenser to the inside of the enclosure.

BRIEF DESCRIPTION OF THE DRAWINGS

Embodiments of the invention are described by way of example with reference to the accompanying drawings, in which.

MORE DETAILED DESCRIPTION

The present invention is applicable to circuit breakers filled with sulfur hexafluoride, or with a mixture of sulfur hexafluoride and nitrogen.

Figure 1:
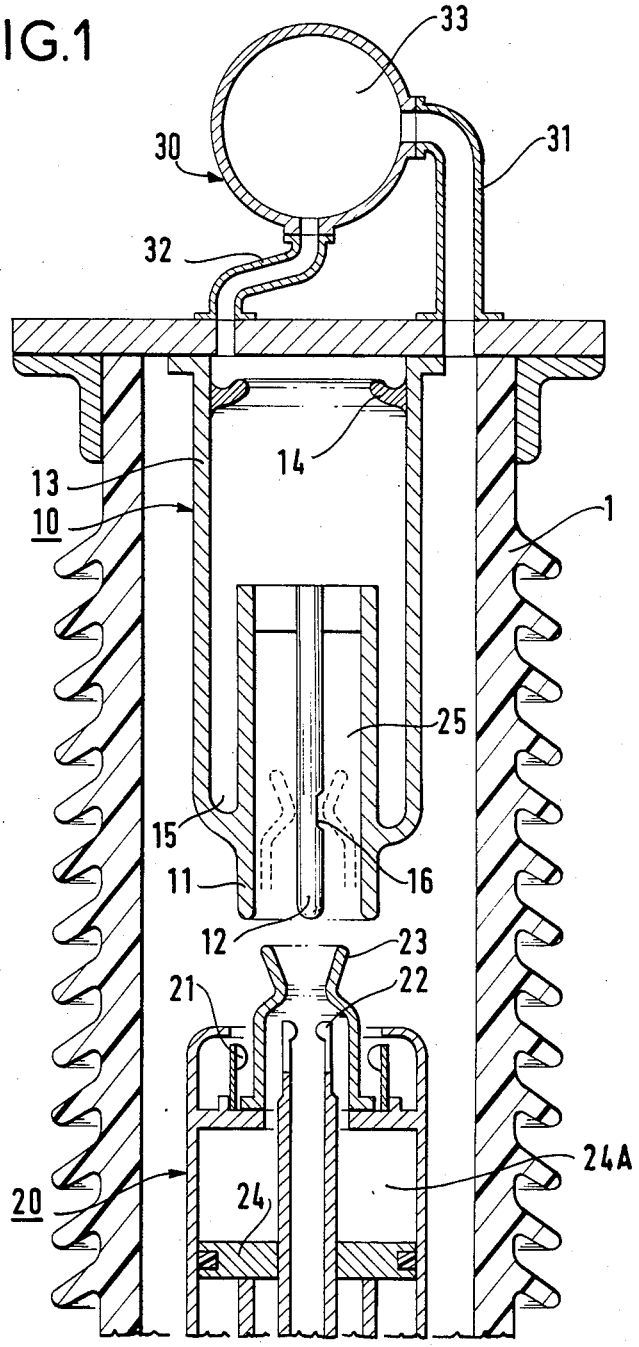
FIG. 1 is an axial section through a portion of a first embodiment of a circuit breaker in accordance with the invention.

FIG. 1 shows an insulating enclosure 1 which is preferably made of porcelain, and which encloses a set of fixed contacts 10 and a set of moving contacts 20. The envelope is filled with insulating gas which, for the sake of simplicity is assumed to be pure sulfur hexafluoride.

The moving assembly comprises a series of contact fingers 21 constituting the moving main contact and cooperating with the fixed main contact 11, together with a series of contact fingers 22 which constitute the moving arcing contact and which co-operate with the fixed arcing contact 12.

A blast nozzle 23 directs the blast gas which is propelled, when the circuit breaker is opened, by a fixed piston 24.

In accordance with the invention, the circuit breaker further includes a fluid condenser 30 placed outside the circuit breaker. The condenser is constituted very simply by a metal receptacle which is connected via two channels 31 and 32 to the outside of the circuit breaker.

The shape of the receptacle is immaterial (it may be spherical, toroidal, etc . . . ). The metal used, and the thickness of metal used are chosen so that the inside wall of the condenser very rapidly takes up a temperature close to the outside temperature in the environment.

The channel 31 is of large diameter (5 cm to 15 cm) and opens out at one end into the circuit breaker enclosure, near its outside wall, and at its other end about halfway up the condenser.

The other channel 32 is of smaller diameter (about 1 cm) and opens out at one end into the bottom of the condenser and at its other end into the center of the circuit breaker.

The basic idea of the invention is to promote condensation in a given location when the temperature is low, thereby avoiding condensation on the inside walls of the circuit breaker.

When the outside temperature falls, condensation takes place preferentially inside the condenser 30. The gas rises via the duct 31 and condenses partially inside the condenser. The condensate 33 flows down the duct 32 towards the inside of the circuit breaker. The duct 32 opens out close to the tube 13 which supports the fixed contact 11, and the tube 13 is provided with an inwardly directed lip 14 which constitutes an overflow to enable a film of liquid $SF_6$ to be formed and to flow down the tube 13. While current is flowing through the circuit breaker, this liquid film evaporates and contributes to increasing the density of $SF_6$ gas inside circuit breaker volume 25.

The tube 13 and the tubular contact 11 meet and form a trough where liquid $SF_6$ may accumulate.

A notch 16 in the fixed arcing contact facilitates downward gas flow when the contacts are in the closed position. This notch is made level with the throat of the blast nozzle, as shown in dashed lines. The heavy gas flows down through the notch 16 and readily enters the volume 24A. When the circuit breaker opens due to a network fault, high density compressed gas is thus obtained through the nozzle 23.

In addition, when interrupting a high intensity current, the current flows through the parts 21, 11 and 13 which are heated by the Joule effect, thereby rapidly vaporizing the liquid $SF_6$ contained in the trough 15 and along the inside wall of tube 13.

Figure 2:
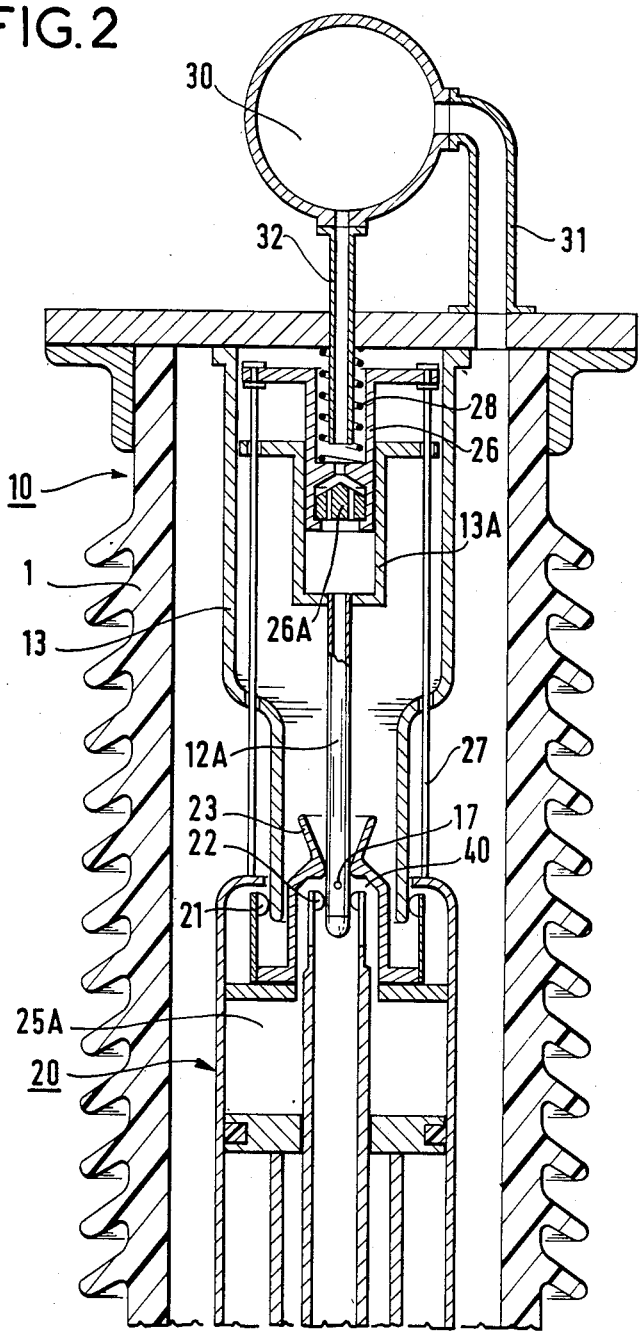
FIG. 2 is an axial section through a portion of a second circuit breaker in accordance with the invention.

FIG. 2 shows a second embodiment of a circuit breaker in accordance with the invention.

Items which are common to FIGS. 1 and 2 have the same reference numerals in both figures.

The circuit breaker is shown in its closed position.

Figure 2A:
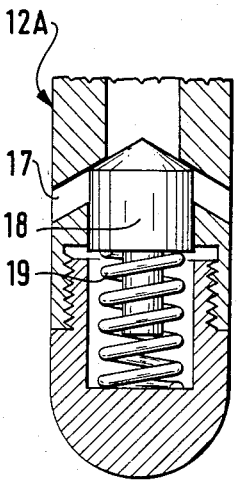
FIG. 2A is a section view on an enlarged scale showing a detail of FIG. 2.

The fixed arcing contact 12A includes small diameter openings 17 near its end, which openings are closable by means of a valve 18 which is resiliently urged towards its closed position by a spring 19 (see detail of FIG. 2A).

The cylinder 13A which bears the fixed arcing contact 12A receives a piston 26 which is mechanically linked by pull rods such as 27 to the moving equipment 20. The piston 26 is hollow and receives the end of the duct 32 coming from the condenser 30. The piston 26 is provided with an orifice 26A fitted with a normally open valve. The condensate from the condenser flows via the duct 32 into the piston 26 and then via the orifice 26A into the contact 12A.

This circuit breaker operates as follows: when the circuit breaker is closed, the spring 28 is compressed by the pull rods 27.

The liquid $SF_6$ which forms at low outside temperature descends, as described above, into the hollow fixed contact 12A.

When the circuit breaker is opened, the spring 28 expands, thrusting against the piston 26 which compresses the gas therebelow, causing the valve 18 to open and spray a mist of $SF_6$ in the arcing zone.

This high density $SF_6$ mist facilitates current interruption.

The valve 26A closes by virtue of the increasing pressure in the interrupting chamber and prevents the gas from rising into the condenser. The gas in the tube 12A may also be compressed by displacing a piston under an electromagnetic attraction or repulsion effect using the short-circuit current through a winding connected in series with the fixed contact 13.

The electromagnetic effect due to the short-circuit current may be used to inject liquid $SF_6$ into the enclosure 25A via the openings 17 for several hundredths of a second prior to the moving contact 20 opening.

In such a solution, pull rods such as 27 are no longer required.

Figure 3:
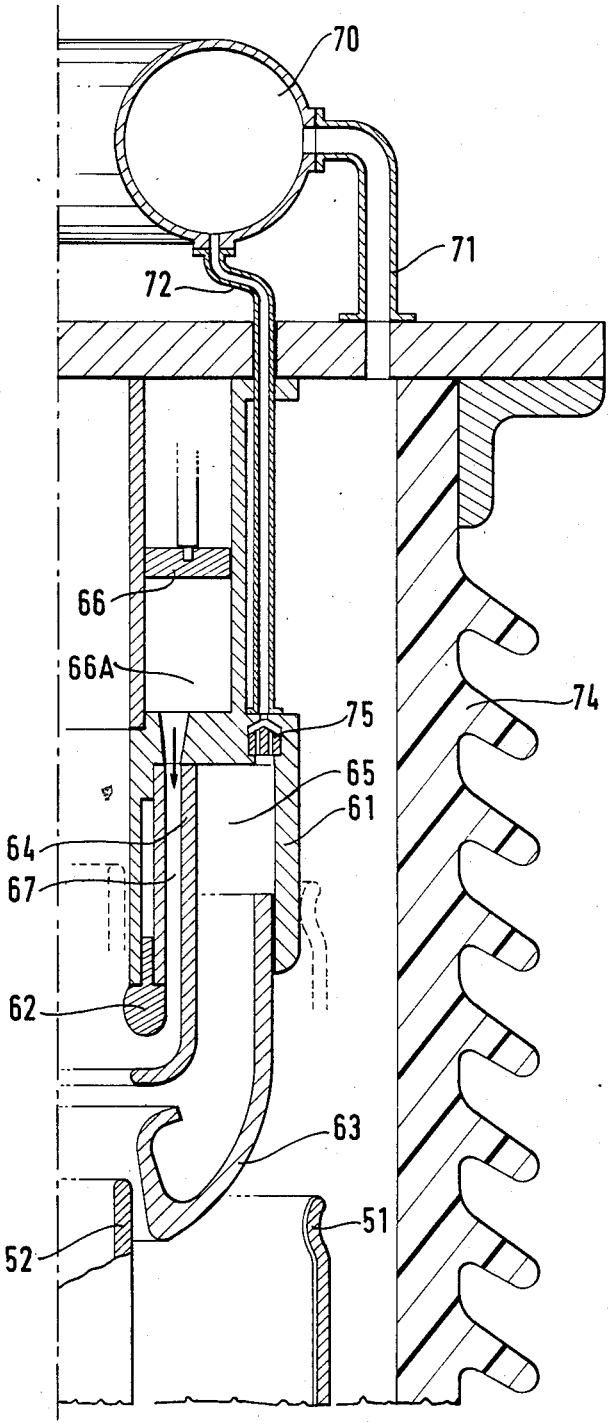
FIG. 3 is an axial section through a portion of a third circuit breaker in accordance with the invention.

FIG. 3 shows a third embodiment of a circuit breaker in accordance with the invention. This circuit breaker is of the type comprising moving equipment including a main contact 51 and an arcing contact 52 and fixed equipment including a fixed main contact 61 and a series of fingers 62 constituting a fixed arcing contact. A nozzle 63 and a deflector 64 delimit a chamber 65 in which the gas is heated and rises in pressure under the effect of the arc which is formed when the arcing contacts separate.

A piston 66 which is mechanically connected to the moving equipment or which is provided with its own displacement means, propels cold gas when the circuit breaker opens through an annular duct formed by the deflector 64 and the contacts 62.

As in the previous example, a condenser 70 is disposed outside the circuit breaker and is connected via two ducts 71 and 72 to the periphery of the circuit breaker. The larger diameter duct 71 opens out into the circuit breaker adjacent to its porcelain wall. The smaller diameter duct 72 opens out into the chamber 65. The condenser is shown as being toroidal in shape.

A valve 75 is closed when the pressure in the chamber 65 increases beyond a set limit and then prevents any communication between the condenser 70 and the chamber 75.

The nozzle 63 is advantageously curved to constitute a gutter for collecting the liquid $SF_6$ which flows along the wall of the chamber 65.

When a large current is being interrupted, the heat generated by the arc vaporizes this $SF_6$ and the $SF_6$ vapor pressure then rises locally, thereby aiding interruption. When low currents are being interrupted, the arc is extinguished by the blast of $SF_6$ which is compressed in the enclosure 66A by means of the piston 66.

Figure 4:
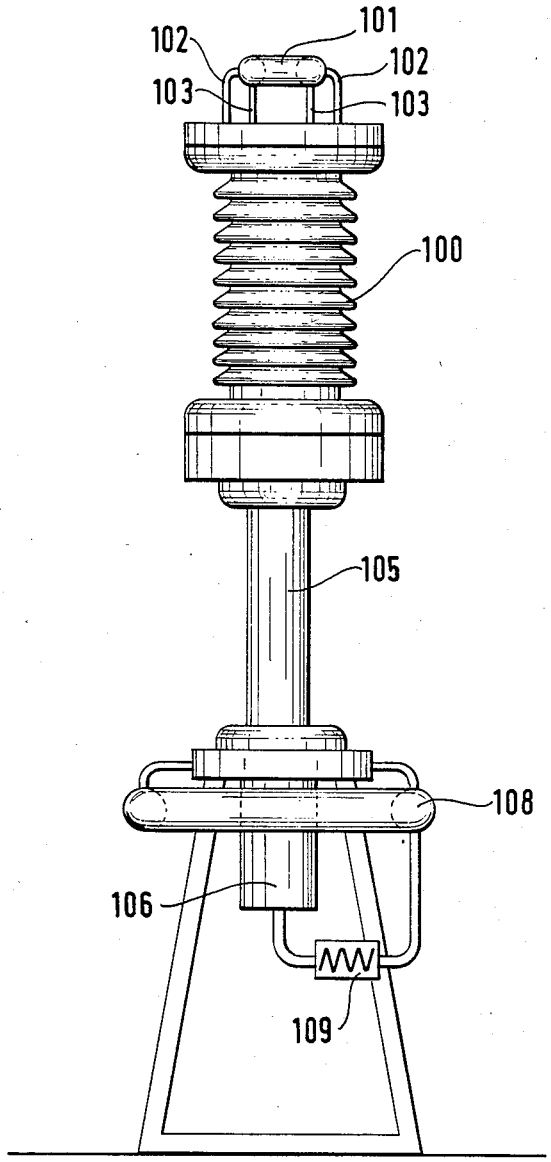
FIG. 4 is a side view of a fourth circuit breaker in accordance with the invention.

FIG. 4 is an overall view of a circuit breaker including a toroidal condenser 101 situated above a current interrupting chamber 100, and having gas inlet ducts 102 and liquid outlet ducts 103.

The column 105 contains rodding for operating the circuit breaker and the chamber 106 contains the circuit breaker drive mechanism.

The bottom of the column 105 is at ground potential.

A second condenser 108 is placed to collect gaseous or already liquified $SF_6$. The condensate is vaporized by a heater member 109 and reinjected into the circuit breaker. The heating energy provided by the member 109 may either be electrical energy or else it may be thermal energy taken from the ground. At a depth of one or two meters underground, the temperature is sufficient for vaporizing liquid $SF_6$ at $-50°$ C. coming from 108.

As already mentioned above, when $SF_6$ condenses, its pressure in the circuit breaker enclosure falls.

The addition of 1 to 2 bars of nitrogen to the $SF_6$ provides better dielectric performance in the contact-open position and improves the mechanical operation of the circuit breaker at very low temperature.

Various other embodiments are shown with reference to FIGS. 5 to 8.

All of these embodiments seek to collect the liquid $SF_6$ which forms during periods when the circuit breaker is open or closed in a zone close to the arcing zone, so that at the moment the circuit breaker is opened, this collected liquid may be projected and sprayed onto the arc by means of compressed gas.

Figure 5:
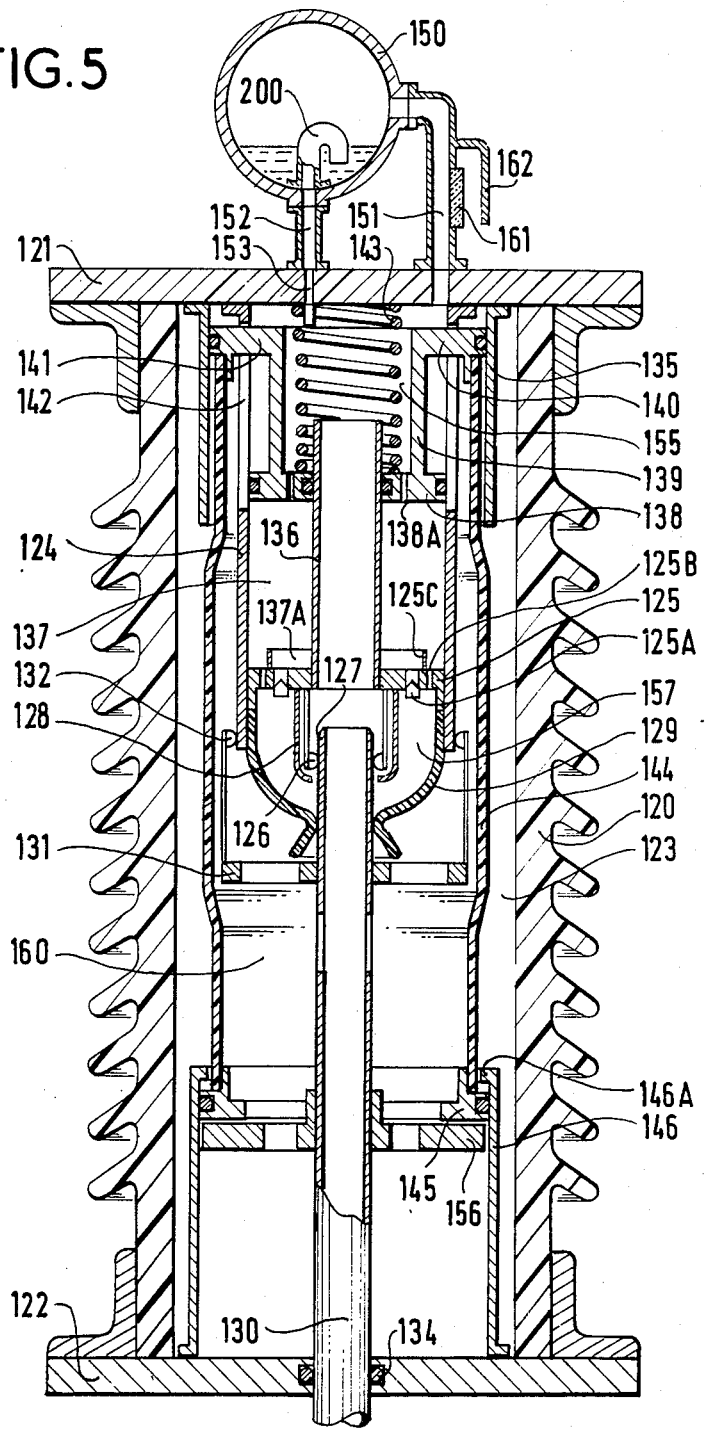
FIG. 5 is an axial section through a portion of a fifth circuit breaker in accordance with the invention and shown in its closed position.

In FIG. 5, reference 120 designates an insulating ceramic enclosure of a circuit breaker which is closed in sealed manner by two end plates 121 and 122, thereby defining a sealed enclosure 123 which is filled with sulfur hexafluoride ($SF_6$) at a pressure of a few bars.

Inside the enclosure 123 there is a set of fixed contacts comprising a tubular main contact 124 and an arcing contact 126. The arcing contact fingers are provided with spark deflectors 128. Both the fingers 126 and the spark deflectors 128 are mounted on a ring 125 which is fixed to the tube 124. An insulating blast nozzle 129 extends the tube 124. The moving assembly comprises a tubular arcing contact 127 at the end of a tube 130 which is connected to drive means (not shown). The tube carries a ring 131 of contact fingers 132 which co-operate with the fixed main contact 124 when the circuit breaker is closed.

The tube 130 slides through the end plate 122, and sealing is provided by a gasket 134.

The fixed assembly also includes two tubes which are mutually coaxial and coaxial with the tube 124.

One of these two tubes, 135, is fixed to the end plate 121, and the other of these two tubes, 136, is disposed in line with the fixed arcing contacts. The tubes 124 and 136 delimit an annular volume 137 in which a piston 138 slides in sealed manner.

The piston is carried by a tube 139 fixed to a ring 140 which slides in guided manner inside the tube 135. The ring 140 is fixed to the tube 139 by arms 141 passing through slots 142 through the tube 124. A spring 143 disposed between the end plate 121 and piston 138 exerts a force thereon tending to displace the piston towards the arcing contacts. An envelope 144 of insulating material having very good high pressure performance, e.g. an epoxy glass, surrounds the arcing zone. It is fixed at one end to the ring 140 and at the other end to a ring 145 which slides in guided manner inside a tube 146 which is fixed to the end plate 122.

As mentioned above, the circuit breaker is provided with a condenser 150 disposed outside the circuit breaker and above it.

The condenser is connected to the circuit breaker by a channel 151 for transferring gas between the inside of the circuit breaker and the condenser.

In addition, a channel 152 which is extended by a tube 153 opening out beneath the end plate 121 serves to allow the liquid which forms in the condenser to flow into the circuit breaker.

This liquid passes into the volume 155 above the piston 138, passes through the piston via channels 138A or via suitable valves, and reaches the volume 137. The ring 125 is fitted with valves 125A which open when the pressure in the volume 137 reaches a given threshold. A screen 125C contains the liquid volume 137 to avoid it flowing via the passages 125B passing through the ring 125.

The screen, 125C together with the adjacent parts defines a receptacle 137A. In order to improve the retention of $SF_6$ in the liquid state and protect it from vaporizing, it is advantageous to thermally insulate the receptacle 137 containing the liquid $SF_6$ from the adjacent metal parts, by means of a thermally insulating layer (not shown).

This circuit breaker operates as follows:

When the circuit breaker is closed, the tube 130 is in its high position (see FIG. 5).

The spring 143 is loaded under the action of the enclosure being thrust by a ring 156 which is fixed to the tubular contact 130 and which bears against the ring 145.

The $SF_6$ gas condenses in the condenser 150 when the ambient outside temperature drops to −20° C. to −50° C.

The liquid $SF_6$ falls into the volume 155 via the tube 153, and then passes through the small holes 138A (or the valves) to be stored in the receptacle 137A. When the circuit breaker is opened (see FIG. 6) the rod 130 is moved downwardly relative to the figure. The piston 138 compresses the gas in the volume 137. The valves 125A open when the pressure in the volume 137 reaches the given threshold. At this moment, the compressed gas in the volume 137 leaves together with the liquid $SF_6$ and is thoroughly mixed in the enclosure 157 surrounding the arcing contacts. The energy of the arc 158 and the compression energy of the moving piston 138 very rapidly increase the temperature of this mixture having a high density of $SF_6$ and thus raise it to a high pressure.

When the short circuit current passes through zero, the arc 158 is extinguished by virtue of a highly energetic blast of this dense gas through the insulating nozzle 129.

The passages 125B in the ring 125 facilitate filling the volume 137 with $SF_6$ during a closure operation by sucking the $SF_6$ from the volume 157.

During this operation the moving contact 130 rises and takes the insulating envelope 144 with it.

When the circuit breaker is opened, the moving contact 130 moves downwardly at a speed which may be higher than the speed of the envelope 144 and of the piston 138. Expansion of the spring 143 serves to compress the gas in the volume 137. The insulating envelope 144 and the cylinders 135 and 146 serve to dynamically separate the pressures in the volumes 123 (outside the enclosure) and 160. The volume 123 is much smaller than the volume 160.

Should the porcelain enclosure 120 of the circuit breaker itself break for any reason, the small volume 123 prevents the porcelain 120 from exploding violently.

The gas in the volume 160 escapes slowly to the atmosphere through the set of guides for the rings 140 and 145, which are thus deliberately poorly sealed.

Should the porcelain 120 break suddenly, the top end plate 121 together with the parts fixed thereto remains attached to the bottom plate 120 and to the moving contact 130 by virtue of the arms 141, the envelope 144, and the abutment 146A of tube 146.

When the pressure in volume 160 rises too high, for example due to a failure to interrupt a current or to an arc being struck between contacts, a safety membrane 161 comes into operation.

A deflector 162 prevents pieces of the membrane 161 from being projected. The presence of the insulating envelope 144 protects the porcelain 120 against rapid rises in pressure.

Figure 6:
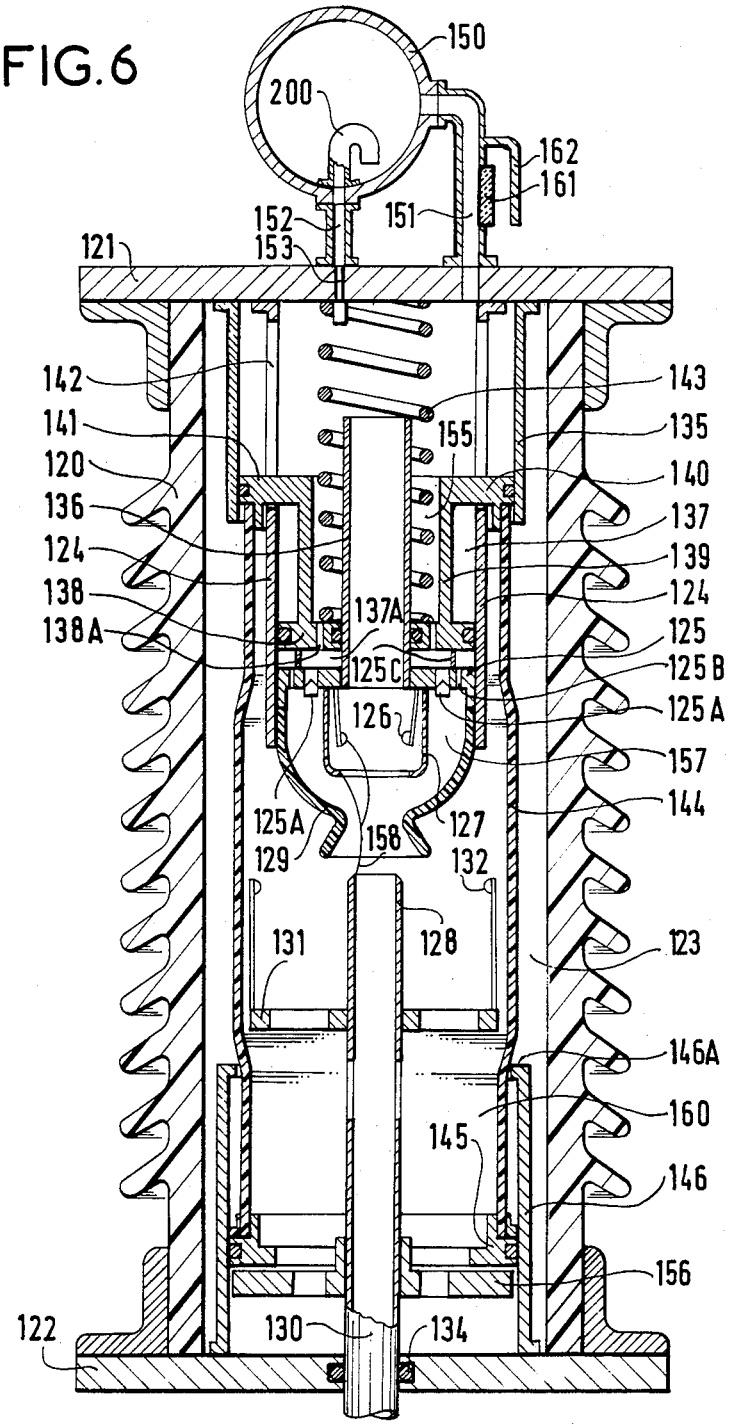
FIG. 6 is an axial section through a portion of the FIG. 5 circuit breaker shown in its open position.
Figure 7:
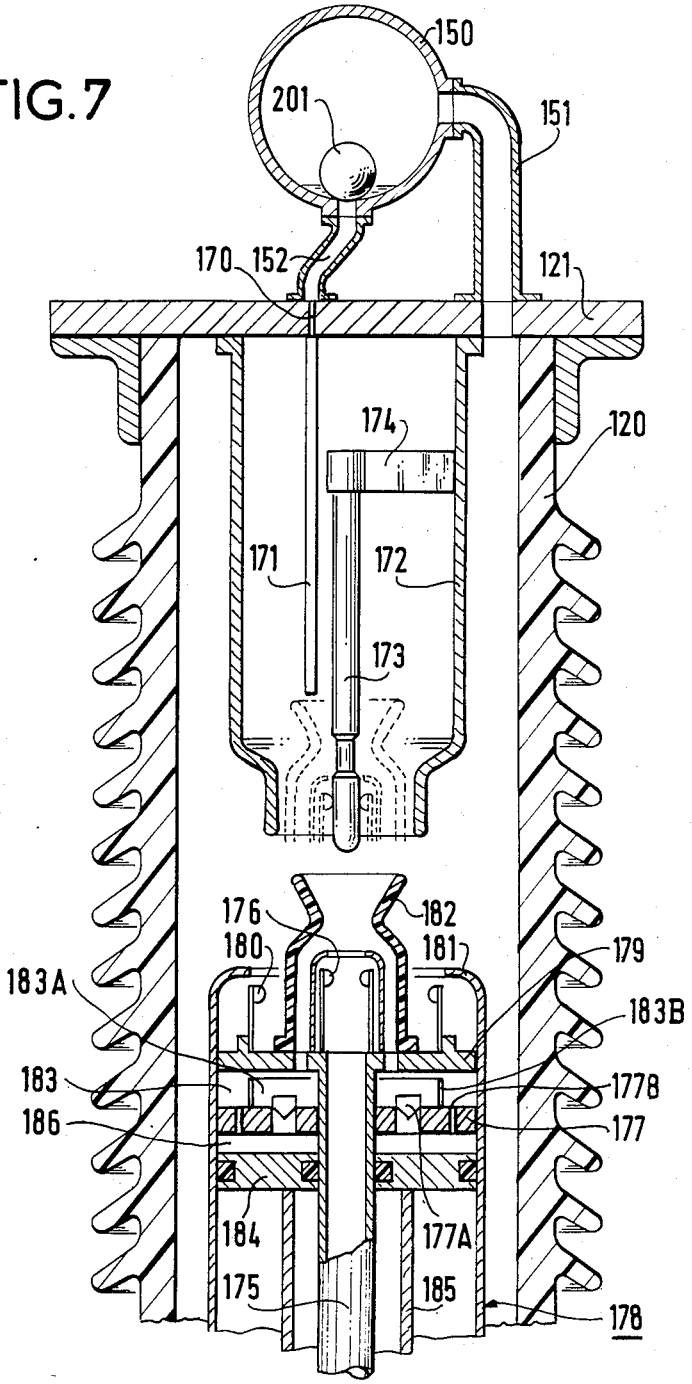
FIG. 7 is an axial section through a portion of a sixth circuit breaker in accordance with the invention.

FIG. 7 shows another embodiment of the invention. Items which are common to FIGS. 5 to 7 have the same references in FIG. 7 as in FIGS. 5 and 6.

Thus there is the same insulating enclosure 120, and the same condenser 150 together with its tubes 151 and 152. The tube 152' is level with a channel 170 through the end plate 121 and is extended by a tube 171 which extends to the vicinity of the nozzle 182 while the circuit breaker is in its closed position.

The set of fixed contacts comprises a tubular main contact 172 and an arcing contact 173 in the form of a rod which is fixed by radial arms 174.

The moving equipment comprises a tube 175 carrying arcing contact fingers 176.

A ring 177 fixes the tube 175 to the tube 178. This tube has a ring 179 with main moving contacts 180 disposed thereon, together with spark deflectors 181 and an insulating blast nozzle 182.

Dashed lines show the position of nozzle 182 and of the arcing fingers 176 when the circuit breaker is closed.

The rings 177 and 179 delimit a volume 183.

The ring 177 has valves 177A and passages 177B.

Finally, the circuit-interruption chamber includes an annular fixed piston 184 carried by a tubular rod 185.

The piston 184 together with the ring 177 delimits a volume 186 to be compressed. When the circuit breaker is closed or open, liquid $SF_6$ flowing along the tube 171 is collected by the funnel constituted by the nozzle 182, flows along the inside surface of the nozzle, and then collects in the receptacle 183A as defined by the screen 183B and adjacent walls. As before, the walls of the receptacle 183A may be provided with thermal insulation.

When the circuit breaker is opened, the volume 183 is reduced by relative displacement of the piston 184 and the ring 177.

The pressure of this volume increases, the valves 177A open, and an energetic blast sprays liquid $SF_6$ from the receptacle 183A and injects it towards the insulating nozzle 182. Because of this blast of a high density mixture of gas and liquid $SF_6$, and because this mixture is raised to a high temperature and compressed by the arc, the current is rapidly interrupted when it passes through zero. In order to ensure that the liquid $SF_6$ is reduced to suitably small droplets in the spray, a large membrane having fine holes therethrough may be fixed to the inlet of the nozzle.

The holes 177B facilitate filling the volume 186 when the circuit breaker is closed.

Figure 8:
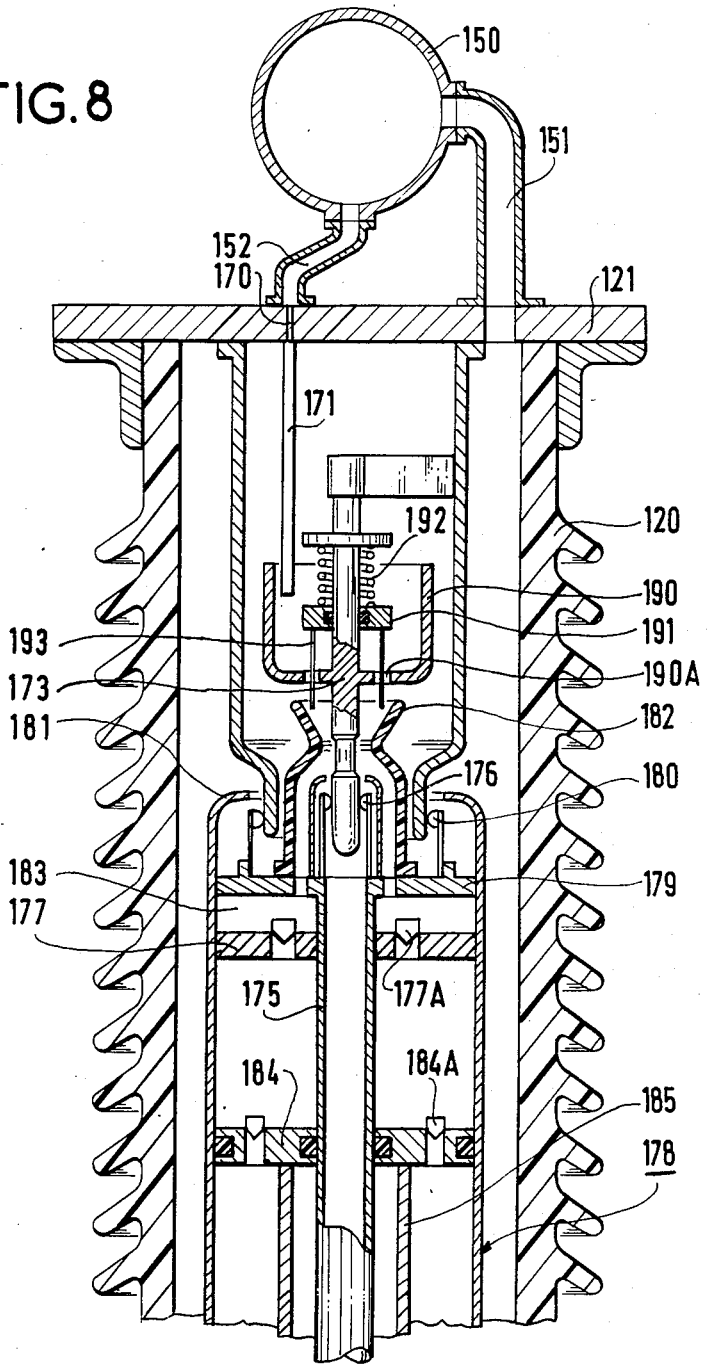
FIG. 8 is an axial section through a portion of a seventh circuit breaker in accordance with the invention.

FIG. 8 shows a circuit breaker which is substantially identical to that shown in FIG. 7 except for the addition of a small tank 190 fitted with openings 190A which, while the circuit breaker is in its open position, are closed by a valve 191 which is biased by a spring 192.

In the closed position of the circuit breaker, rods 193 projecting downwardly from the valve plate bear against the nozzle and keep the valve open, thereby allowing liquid $SF_6$ to flow into the volume 183.

The piston 184 has valves 184A for facilitating $SF_6$ filling during circuit breaker closing.

The disposition of FIG. 8 serves to collect a certain quantity of liquid $SF_6$ during periods for which the circuit breaker is open, which quantity remains above the arcing zone and is conveyed into the volume 183 on closure. With this disposition, the liquid $SF_6$ does not fall into the volume 183 when the circuit breaker is in its open position.

It will be understood that by using an insulating nozzle of larger size than that shown in FIG. 5, and by raising the fingers 180 on the fixed contact tube 172, liquid $SF_6$ may be stored inside the insulating nozzle itself. This brings the liquid $SF_6$ even closer to the arcing zone.

In order to fill the receptacle with liquid $SF_6$, it is advantageous to cause the liquid $SF_6$ to flow down from the condenser 150 via the tube 171 only when a given volume of liquid $SF_6$ has accumulated in the condenser.

This may be achieved, either by using a siphon device as shown in FIGS. 5 and 6 under the reference 200, or else by using a float 201 (as shown in FIG. 7).

Figure 9:
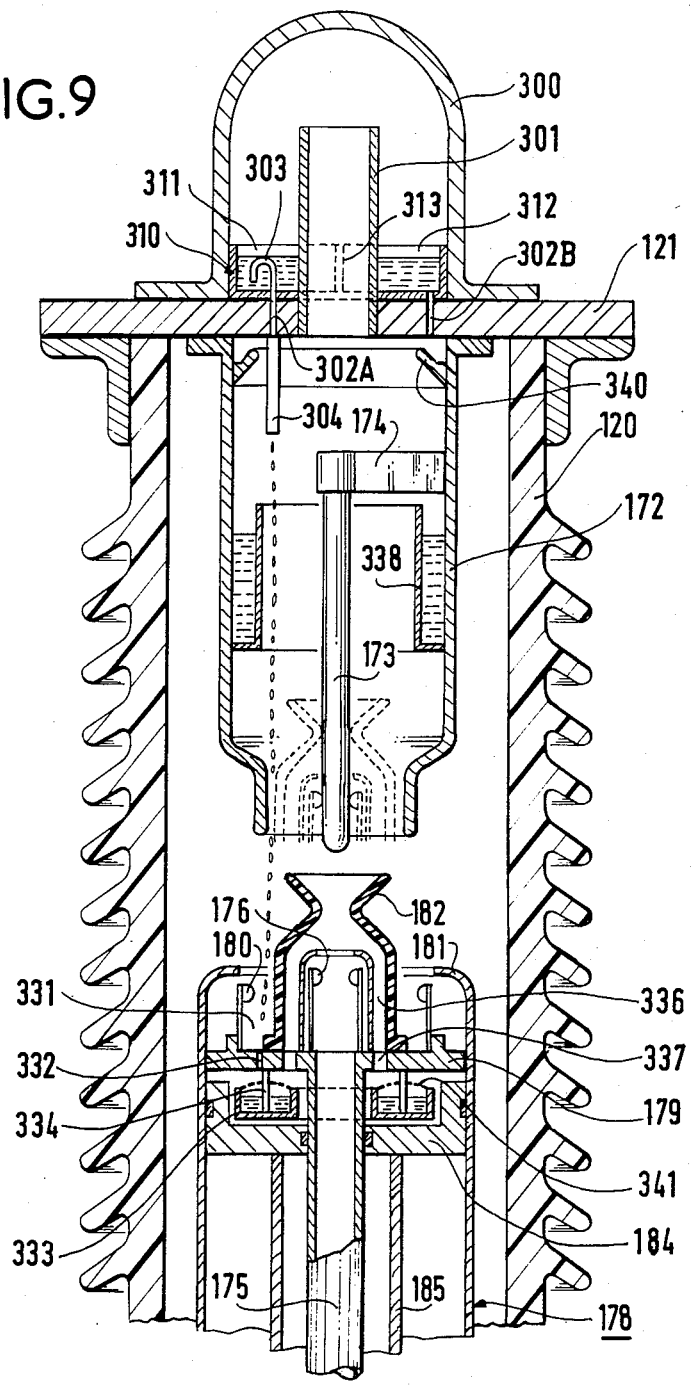
FIG. 9 is an axial section through a portion of an eighth circuit breaker in accordance with the invention.
Figure 10:
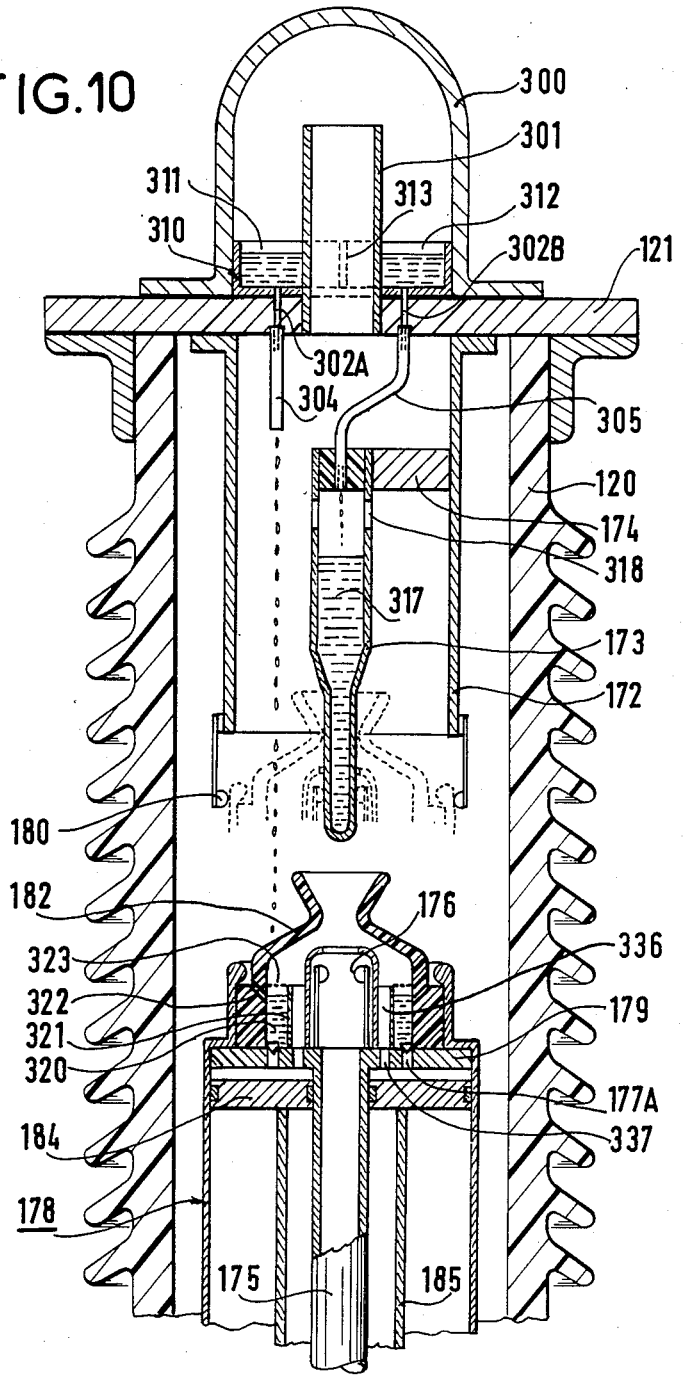
FIG. 10 is an axial section through a portion of a ninth circuit breaker in accordance with the invention.

FIGS. 9 and 10 show two further embodiments.

These embodiments also seek to collect liquified gas which forms during periods when the circuit breaker is closed or open, and to keep said liquified gas in a region close to the arcing zone, so that at the moment when the circuit breaker is opened, the liquid gas may be projected as a spray onto the arc by means of compressed $SF_6$ gas.

In FIG. 9, the same insulating enclosure 120 of the circuit breaker is covered by the same top end plate 121 with the same set of fixed contacts comprising a tubular main contact 172 and an arcing contact 173 constituted by a rod held by means of radial arms 174, with the moving assembly comprising the main contact 180 and the arcing contact 176.

The moving assembly is surrounded by an outer tube 178 whose end constitutes a spark barrier 181.

The moving assembly also includes an inner tube 175 provided at its end with a ring 179 which is fitted inside the outer tube 178, together with a fixed annular piston 184 carried by a tubular rod 185, an insulating blast nozzle 182, and an annular tank 333 which is fixed to the ring 179 by rods 334. The main contact 180 and the arcing contact 176 are carried by the ring 179.

An annular space 331 is established between the main contact 180 and the nozzle 182, and an orifice 332 made through the ring 179 puts the annular space 331 into communication with the tank 333 which is covered by a grid 341.

The ring 179 also comprises orifices 337 putting the tank 333 into communication with an annular space 336 inside the insulating nozzle 182.

The end plate 121 is fitted with a bell-shaped condenser 300 which may optionally be fitted with cooling fins.

A transfer channel 301 acts as the first channel and transfers gas between the inside of the enclosure and the condenser.

Two small separate transfer channels 302A and 302B, hereinafter referred to as orifices 302A and 302B, act as the second channel for transferring liquified gas from the condenser to the inside of the enclosure.

The condenser houses an insulating basin 310 which is divided in two by a partition 313 to constitute two compartments 311 and 312 which may be of the same size, but which need not be of the same size.

The compartment 311 is connected to the orifice 302A by a siphon 303 and this orifice is extended by a tube 304, while the compartment 312 is in direct communication with the orifice 302B.

The tubular contact 172 includes a gutter 340 and an annular tank 338 constituted by an annular partition.

Dashed lines show the position of the nozzle 182 and of the arcing contact 176 when the circuit breaker is in the closed position.

This circuit breaker operates as follows:

When the circuit breaker is closed, the moving assembly is in its high position as shown by the dashed lines.

If the ambient temperature drops, for example down to $-15°$ C. or below, $SF_6$ gas condenses in the condenser 300. This condensation causes the pressure to drop slightly and gas is thus sucked from the circuit breaker enclosure into the condenser via the channel 301.

The liquid $SF_6$ is stored in the insulating basin 310 and thus in the two compartments 311 and 312.

Once the liquid $SF_6$ has reached a given level, it is transferred from the compartment 311 into the space 331 via the siphon 303 fitted to the orifice 302A and via the tube 304, and thus via the orifice 332 into the tank 333. At the same time, liquid $SF_6$ is transferred from the compartment 312 into the tank 330 via the orifice 302B and the gutter 340.

When a current is to be interrupted, the liquid $SF_6$ is projected by virtue of the acceleration of the moving contact against the ring 179 and is entrained into the internal space 336 via the orifices 330 by the $SF_6$ gas compressed in the cylinder.

The gas arrives at the throat of the nozzle 182 in the form of a mist.

The effect of the arc is to cause the pressure of this gas to rise rapidly, thereby greatly facilitating fault current interruption.

In order to obtain fine droplets of liquid $SF_6$ when the circuit breaker is opened, a fine grid 341 is used, and in order to conserve the liquid $SF_6$ better in the tank 333, this tank is thermally isolated from the surrounding metal parts.

The tank 333 and its fixing rods 334 may be replaced by a single flexible bellows-like receptacle fixed to the ring 179.

In order to inject more liquid $SF_6$, the tank 333 and its rods 334 may be replaced by a flexible, bellows-like tank, and this flexible tank may come into contact with the piston 184 towards the end of its stroke during a circuit-breaking operation.

FIG. 10 has many items in common with the embodiment shown in FIG. 9. In particular, the fixed assembly comprising the main contact 172, the arcing contact 173 fixed by its radial arms 174, and the moving assembly comprising the outer tube 178, the inner tube 175, having the ring 179 at its end, the tubular rod 185 carrying the fixed piston 184, the blast nozzle 182 and the arcing contact I76 are all the same, as are the condenser 300, the transfer channel 301, the two small transfer channels 302A and 302B, the tube 304, the insulating basin 310, and its two compartments 311 and 312.

However, in this embodiment the inside of the arcing contact 173 constitutes a tank 317 which is connected to the compartment 312 of the insulating basin 310 via the orifice 302B and a tube 305. The top of the tank 317 has an opening 318 which provides better contact with the surrounding gas when the liquid $SF_6$ is being vaporized.

Unlike the FIG. 9 embodiment, the main contact 180 is not installed on the moving equipment, but rather on the fixed equipment at the end of the main contact 172, with the contact 180 pressing against a shoulder on the outside of the tube 178. Inside the moving assembly, the liquid tank is placed inside the insulating nozzle 182, and this tank 320 as constituted by a partition 321 is put into communication with the free space between the ring 179 and the piston 184 by valves 177A. The free space is in permanent communication with an annular space 336 by orifices 337.

The insulating nozzle 180 includes an orifice 322 for feeding the tank 320 with liquid $SF_6$.

A fine grid 323 is placed at the top of the tank 320 in order to facilitate splitting the liquid $SF_6$ into small droplets.

This circuit breaker operates as follows:

The liquid $SF_6$ leaving the condenser via the tube 304 falls onto the nozzle 382 via the orifice 322 and thus into the tank 320.

When a current is being interrupted, the compressed $SF_6$ and the valves 177A serve to rapidly inject a spray of liquid $SF_6$ towards the arcing zone. The compressed $SF_6$ gas also passes through the orifices 337.

The liquid $SF_6$ leaving the condenser via the channel 305 falls into the arcing contact tube 173.

We claim:

1. A high tension circuit breaker comprising a sealed enclosure having a fixed assembly and a moving assembly disposed therein, said fixed assembly and said moving assembly each including a respective main contact and a respective arcing contact forming an arcing zone, and said enclosure being filled with gas under pressure constituted, at at least in part, by sulfur hexafluoride, the circuit breaker including the improvement of a fluid condenser disposed outside the circuit breaker and subject to ambient temperature with the inside of the condenser being in communication with the inside of the enclosure via at least one first channel for transferring gas between the inside of the enclosure and the condenser, and via at least one second channel for transferring condensed, liquified gas from inside the condenser to the inside of the enclosure, and said second channel comprises means to supply liquified gas to said arcing zone.

2. A circuit breaker according to claim 1, wherein the condenser is a hollow metal sphere.

3. A circuit breaker according to claim 1, wherein the condenser is a hollow metal torus.

4. A circuit breaker according to claim 1, wherein the first channel opens out into the enclosure close to the outer wall thereof.

5. A circuit breaker according to claim 1, wherein the second channel opens out into the enclosure close to a metal tube which constitutes a support for the main fixed contact.

6. A circuit breaker according to claim 5, wherein said tube includes a lip constituting an overflow rim for liquified gas coming from the condenser, thereby forming a film of liquid on the inside wall of said tube.

7. A circuit breaker according to claim 5, wherein said tube includes a trough located in the vicinity of said fixed arcing contact in order to collect liquified gas.

8. A circuit breaker according to claim 1, wherein the fixed arcing contact is a tube which is closed at its end situated in the arcing zone and which receives the liquified gas, said tube having at least one orifice towards said end, which orifice is closable by a valve, and means for opening said valve when the circuit breaker performs a circuit breaking operation.

9. A circuit breaker according to claim 8, wherein said orifices are located opposite an outlet for the gases compressed inside the enclosure.

10. A circuit breaker according to claim 7, including a piston, and means for moving said piston on the circuit breaker opening to compress the gas above the liquid contained in the fixed arcing contact.

11. A circuit breaker according to claim 10, wherein the piston is displaced under the electromagnetic effect of a coil having the short circuit current flowing therethrough.

12. A circuit breaker according to claim 1, including a thermal chamber constituted by a nozzle extending the fixed main contact, and by a deflector surrounding the fixed arcing contact, said second channel opening out into said thermal chamber.

13. A circuit breaker according to claim 12, wherein said nozzle is curve to constitute a gutter for collecting liquified gas coming from the condenser.

14. A circuit breaker according to claim 1, including a second fluid condenser disposed outside the circuit breaker level with parts at ground potential, said second condenser being connected to the inside of the circuit breaker by first channels for conveying gas, with the condensed liquid being conveyed to a device for evaporating said liquid, with the outlet from said device being in communication with the inside of the circuit breaker.

15. A circuit breaker according to claim 1, including a storage receptacle in which liquid $SF_6$ from the condenser may accumulate, said receptacle being placed in a volume capable of being compressed on circuit breaker opening and being provided with valves via which a mixture of compressed gas and liquid $SF_6$ is projected into the arcing zone.

16. A circuit breaker according to claim 15, wherein said second channel leads to said storage volume such that the liquid $SF_6$ from the condenser falls into the fixed storage volume under its own weight.

17. A circuit breaker according to claim 15, wherein the contact zone is separated from the ceramic side walls of the enclosure by a moving insulating envelope having good high pressure performance.

18. A circuit breaker according to claim 15, wherein said insulating envelope is fixed to a piston which is slidable mounted in a fixed chamber placed in the vicinity of the arcing contacts.

19. A circuit breaker according to claim 17, wherein the volume lying between the side walls of the enclosure and of the envelope is much smaller than the inside volume of the envelope.

20. A circuit breaker according to claim 17, wherein the ends of the envelope are guided in tubes which are poorly sealed.

21. A circuit breaker according to claim 17, wherein the spring is loaded on circuit breaker closing by the movement of the envelope, which envelope is driven by the moving arcing contact.

22. A circuit breaker according to claim 1, wherein the moving assembly comprises a cylindrical compression chamber having a fixed piston disposed therein, and an upper chamber disposed above the compression chamber and receiving the liquified gas in a receptacle, said upper chamber being provided with valves which open directly into the arcing zone to blast gas and liquid $SF_6$ into the arcing zone when the pressure has reached a given value in the compression chamber by virtue of the volume thereof being reduced, when the circuit breaker opens, by relative movement between the piston and the moving assembly.

23. A circuit breaker according to claim 1, comprising in the vicinity of the arcing zone, a small receptacle for receiving liquified gas when the circuit breaker is in its open position, said small receptacle having openings which lead directly to an insulating nozzle surrounding the arcing contacts, with opening being provided by a valve which opens only when the circuit breaker closes.

24. A circuit breaker according to claim 22, wherein the liquid $SF_6$ from the condenser falls under its own weight into the moving storage volume by running along the inside surface of the insulating nozzle.

25. A circuit breaker according to claim 15 or 23, wherein the receptacle is thermally insulated.

26. A circuit breaker according to claim 15, including means for causing $SF_6$ to fall after a predetermined quantity thereof has condensed.

27. A circuit breaker according to claim 26, wherein said means comprise a siphon or a float placed in the condenser.

28. A circuit breaker according to claim 1, wherein the condenser includes an insulating basin in which liquified gas is accumulated, said basin being divided into two independent compartments by a partition, and the second transfer channel being divided into two separate small channels each in communication with a respective one of the compartments in the insulating basin.

29. A circuit breaker according to claim 28, wherein a portion of the liquified gas leaves one of the compartments of the insulating basin via a siphon connected to a small transfer channel and falls under its own weight passing through an orifice into an annular tank placed under the nozzle and fixed to the moving assembly, and wherein another portion of the liquified gas leaves the other compartment of the insulating basin via the other small transfer channel and flows into an annular tank inside the main contact of the fixed assembly.

30. A circuit breaker according to claim 28, wherein a portion of the liquified gas leaves one of the compartments of the insulating basin via a small transfer channel and falls under its own weight into an annular tank inside the nozzle, and wherein another portion of the liquified gas leaves the other compartments of the insulating basin via the other small transfer channel and passes via a tube into a tank inside the arcing contacts of the fixed assembly.

* * * * *